US006631707B1

(12) United States Patent
Bender et al.

(10) Patent No.: US 6,631,707 B1
(45) Date of Patent: Oct. 14, 2003

(54) DEVICE FOR RECIRCULATING THE EXHAUST GAS OF AN INTERNAL COMBUSTION ENGINE

(75) Inventors: Franz Bender, Wendlingen (DE); Jürgen Huter, Weissach (DE); Rüdiger Pfaff, Stuttgart (DE); Joachim Wiltschka, Fellbach (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/959,678

(22) PCT Filed: May 3, 2000

(86) PCT No.: PCT/EP00/03960

§ 371 (c)(1),
(2), (4) Date: Jan. 28, 2002

(87) PCT Pub. No.: WO00/68560

PCT Pub. Date: Nov. 16, 2000

(30) Foreign Application Priority Data

May 5, 1999 (DE) ..... 199 20 520

(51) Int. Cl.[7] ..... F02M 25/07
(52) U.S. Cl. ..... 123/568.12; 123/568.11
(58) Field of Search ..... 123/568.11, 568.12

(56) References Cited

U.S. PATENT DOCUMENTS 3,828,746 A * 8/1974 De Martelaere ..... 123/568.29
4,266,524 A * 5/1981 Perez et al. ..... 123/568.11
4,343,284 A * 8/1982 Martinez-Delgado ..... 123/25 F
5,682,746 A 11/1997 Von Hoerner
6,161,519 A * 12/2000 Kimura et al. ..... 123/299
6,237,330 B1 * 5/2001 Takahashi et al. ..... 60/285
6,286,312 B1 * 9/2001 Bertilsson ..... 60/605.2
6,334,437 B1 * 1/2002 Jessberger ..... 123/568.12

FOREIGN PATENT DOCUMENTS

| | | |
|---|---|---|
| DE | 2802095 A1 | 7/1978 |
| DE | 19624901 C2 | 8/1997 |
| EP | 0908615 A2 | 10/1998 |
| EP | 0887540 A2 | 12/1998 |

OTHER PUBLICATIONS

Patent abstracts of Japan, Abstract of Publication No. 07238871, Yoshida Katsunari, "Exhaust Gas Recirculation Controller", published Sep. 12, 1995.

* cited by examiner

*Primary Examiner*—Henry C. Yuen
*Assistant Examiner*—Douglas A. Salser
(74) *Attorney, Agent, or Firm*—Crowell & Moring LLP

(57) ABSTRACT

A device for recycling exhaust gases from an internal combustion engine via an exhaust gas line in its intake area is equipped with an exhaust gas valve that is positioned within a valve chamber and closes off or opens up the connection to a combustion chamber of an internal combustion engine. A valve actuating mechanism is located within the valve chamber. The valve chamber is equipped with at least one cooling channel.

17 Claims, 2 Drawing Sheets

DEVICE FOR RECIRCULATING THE EXHAUST GAS OF AN INTERNAL COMBUSTION ENGINE

BACKGROUND OF THE INVENTION

The present invention relates to a device for recycling exhaust gas from an internal combustion engine.

A device of the type mentioned above is described in EP 0 887 340 A2. In this design, a cooling channel for cooling the system is provided within the valve chamber, which encircles the valve guide like a ring and is connected to the cooling system of the internal combustion engine.

To prevent a valve stem or valve spindle and the a valve stem guide from becoming fouled, a bushing arrangement is known from German publication DE 196 37 078 A1, in which a bushing is provided around the valve stem. This bushing serves to protect the valve stem guide against thermal radiation and contamination. The effectiveness of this bushing arrangement, however, is limited.

In German publication DE 44 24 644 C1, an exhaust gas recycling valve comprising a valve socket that is positioned within an intake channel and serves to carry the exhaust gas is described. The valve socket is enclosed by a highly thermally conductive flange, which serves to abstract high levels of heat from the hot exhaust gas, thereby allowing more cost-effective injection-molded plastic components to be used in the exhaust gas recycling system.

As is apparent from the current state of the art, devices of the type mentioned above present problems in terms of temperature. On one hand, the exhaust gas valve should be positioned as close as possible to the point at which exhaust gas exits the internal combustion engine, in order to prevent cooled exhaust gases from accumulating as a result of carbonization of the exhaust gas particles, a condition that would interfere with the functioning of the valve. On the other hand, the high exhaust gas temperatures that are required to prevent carbonization require components that are sufficiently heat-resistant, and hence cost-intensive. Furthermore, actuating the exhaust gas valve via an electromagnetic actuating mechanism, which is positioned within the valve chamber, presents a temperature problem for certain components. Due to the danger of carbonization, greater actuating forces must be used, which then require more costly components.

It is thus one object of the present invention to provide a device of the type mentioned above, with which higher exhaust gas temperatures and an effective outflow of exhaust gases can be achieved.

With an exhaust gas collection chamber according to the invention, from which the exhaust gas return line branches, an effective, low-friction outflow of exhaust causes can be attained.

This and other things are achieved via a spherical shape, which results in lower flow losses, and thus low friction losses.

Another possibility for generating low flow losses is to connect the funnel-shaped exhaust gas return line to the spherical exhaust gas collection chamber. In this manner, an angle-free, and thus low-friction, flow can be achieved.

In accordance with the invention, the valve seat of the exhaust gas valve can have a stepped contour, such that when the valve is opened, at least two different angles of aperture are created, with a smaller angle being produced when the valve is first opened.

Because the valve seat for the exhaust gas valve has a stepped contour in accordance with the invention, when the valve is opened, the smaller angle of aperture at the start of exhaust gas recycling permits significantly improved control, and thus a metered recycling of exhaust gases, with a corresponding degree of sensitivity.

Additional advantageous embodiments and further developments are specified in the claims, relating to the exemplary embodiment described in principle below, with reference to the drawings.

DETAILED DESCRIPTION OF THE INVENTION

Figure 1:
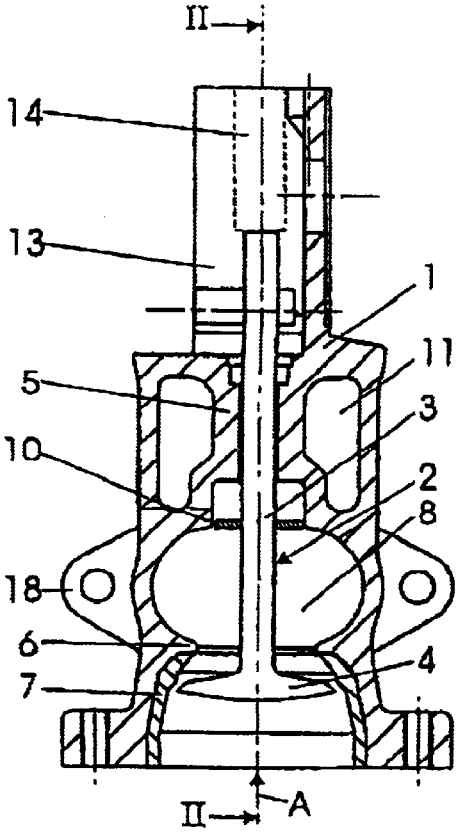
FIG. 1 is a longitudinal section, along the line I—I in FIG. 2, of a valve chamber in an exhaust gas recycling valve.

In a valve chamber 1, an exhaust gas valve 2 comprising a valve stem 3 and a valve head 4 at its forward end is positioned within a valve guide 5 that encompasses the valve stem 3. The valve head 4 of the valve 2 operates in conjunction with a valve seat 6 within the valve chamber 1, which is formed by an insertion sleeve 7. Below, the design of the insertion sleeve 7 (illustrated only in FIG. 1) will be described in greater detail.

Exhaust gas from the outlet point of an internal combustion engine, not illustrated here, flows in the direction A into the valve chamber 1, and is collected in a spherical exhaust gas collection chamber 8 when the valve 2 is open. An exhaust gas return line 9 branches off from the exhaust gas collection chamber 8. The exhaust gas return line 9 is funnel-shaped, and is attached along the center plane of the sphere on its outer wall, resulting in a low-friction flow from the exhaust gas collection chamber 8.

As can be seen from the exhaust gas valve, which for purposes of clarity is shown only in FIG. 1, the valve stem 3 is covered by a cap 10. The position of the cap 10, which follows the movements of the exhaust gas valve 2, is such that when the valve is opened—as is shown in FIG. 1—the underneath side of the cap is nearly flush with the wall of the exhaust gas collection chamber 8, producing an angle-free shape to the wall of the exhaust gas collection chamber, thus preventing flow losses that could be caused by protruding edges or by recesses.

Figure 2:
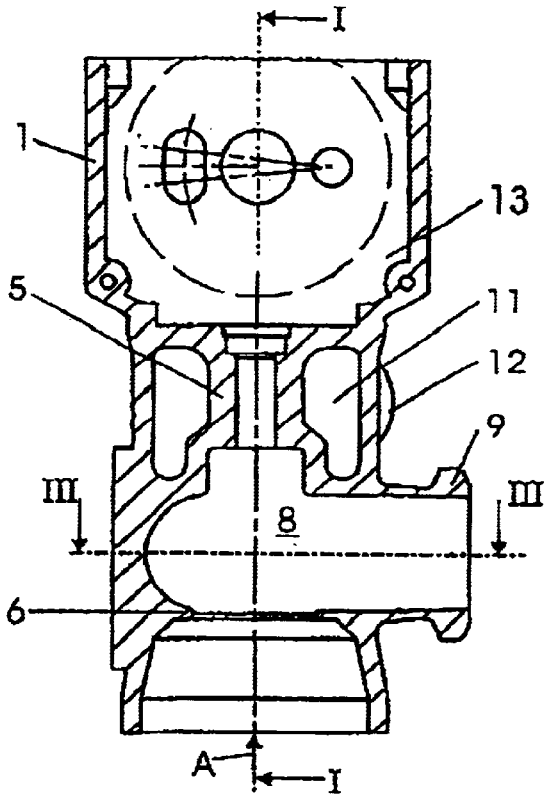
FIG. 2 is a longitudinal section, along the line II—II in FIG. 1, of a valve chamber in an exhaust gas recycling valve.
Figure 3:
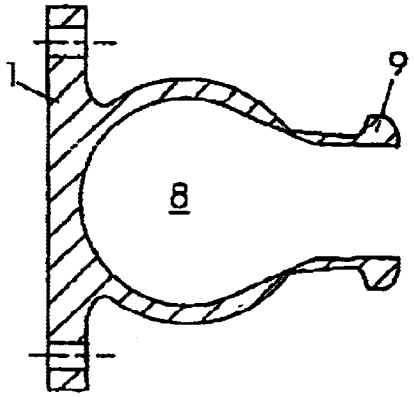
FIG. 3 is a cross-section, along the line III—III in FIG. 2, of a valve chamber in an exhaust gas recycling valve.
Figure 4:
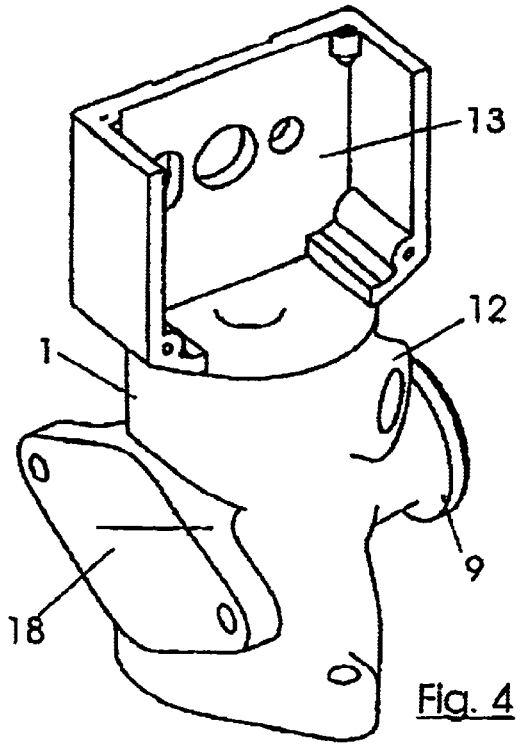
FIG. 4 is a perspective view of the valve chamber.

As can be seen in FIGS. 1 and 2, the valve chamber 1 is equipped with a cooling channel 11 in the area of the valve guide 5, with this cooling channel encircling the valve guide 5 like a ring, effectively reducing the temperature inside the valve chamber, without requiring an increase in its dimensions. The flow into the cooling channel 11 is effected via a connecting branch 12. The connecting branch 12 is connected to the cooling system of the internal combustion engine in a manner not illustrated here—as is a return line, also not illustrated here.

In the known manner, an uptake chamber 13 is positioned above the valve guide, or on the side of the valve chamber that faces away from the valve head 4, and houses actuating mechanisms 14 for the exhaust gas valve, which in FIG. 1 are illustrated only schematically.

As is shown here, the uptake chamber 13 for the actuating mechanism 14 is well protected by the cooling channel 11 against the high temperatures of the exhaust gas that enters the valve chamber 1. This makes it possible for the valve chamber 1 to be positioned very close to the internal combustion engine, or even flange-mounted to the internal combustion engine via a mounting flange 18, which keeps the exhaust gas temperature within the valve chamber 1 high enough to prevent accumulation on the valve stem, which could otherwise interfere with the functioning of the valve. In this manner also, no major actuating forces are required for opening and closing the exhaust gas valve 2, hence the actuating mechanism 14 can be designed to be more cost-effective.

Figure 5:
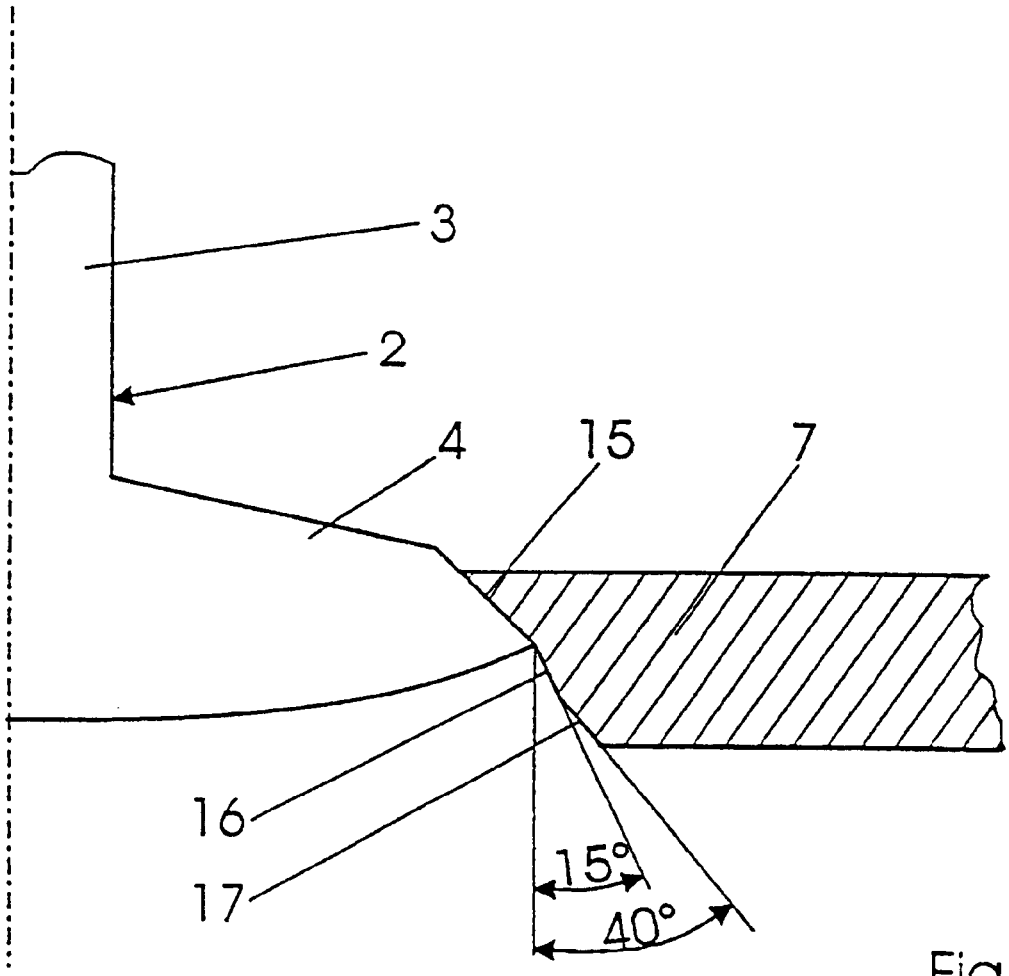
FIG. 5 is an enlarged representation of the valve seat and the lower section of the valve.

As can be seen in FIG. 5, the valve seat 6 or the insertion sleeve 7 which forms the valve seat 6, has a stepped contour. A first step 15 conforms with the peripheral wall of the valve head 4 such that a closed position, and thus a sealing off of the exhaust gas collection chamber 8, is achieved. In a second step 16—created as the exhaust gas valve 2 is opened—the angle of aperture that is produced is smaller than with a third step 17, in which the exhaust gas valve 2 is fully opened. The angle of aperture for the second step 16 may be, for example, 15° from the longitudinal axis of the exhaust gas valve 2, while the angle of aperture for the third step may, for example, be 40° from the longitudinal axis of the exhaust gas valve 2. The two steps 16 and 17, with their different angles of aperture, allow a particularly sensitive control of the quantity of recycled gas, especially when the valve is partially opened.

In contrast to the exemplary embodiments illustrated in the diagrams, an alternative or supplemental elimination of heat from the valve chamber can be achieved via the creation of heat bridges from the chamber to the surrounding components, for example via contact surfaces. These may be designed as a mounting flange that is larger than the mounting flange 18 illustrated in FIG. 1, which would then be mounted flat or pressed against (large) opposing surfaces of the engine casing. It is particularly advantageous for the contact surfaces to be arranged along cooled opposing surfaces of the engine casing, such as surfaces of the cylinder head.

In accordance with a further embodiment, in addition to or in place of the above-described measures, the heat that is within the exhaust gas recycling valve may be emitted into the environment via cooling gills. These are preferably positioned in the area of the exhaust gas collection chamber 8 and/or within the cooling channel 11.

What is claimed is:

1. A device for recycling exhaust gas from an internal combustion engine via an exhaust gas return line in an intake channel of the internal combustion engine, comprising:

an exhaust gas valve positioned within a valve chamber, provided with a valve head, and designed to seal off or open up a connection to a combustion chamber of the internal combustion engine;

a valve actuating mechanism positioned within the valve chamber;

at least one cooling channel, and an exhaust gas collection chamber, which is at least nearly spherical in shape, positioned behind the valve head of the exhaust gas valve, the exhaust gas return line being connected to the exhaust gas collection chamber.

2. The device in accordance with claim 1, wherein the exhaust gas return line is funnel-shaped, and wherein the exhaust gas return line is connected to the exhaust gas collection chamber.

3. The device in accordance with claim 1, wherein the exhaust gas valve has a valve stem covered by a cap, which, when the exhaust gas valve is open, lies at least nearly flush with a peripheral wall of the exhaust gas collection chamber.

4. The device in accordance with claim 1, wherein the exhaust gas valve has a valve seat which is stepped such that, when the valve is opened, at least two different angles of aperture are possible, with a smaller angle of aperture being created when the valve is first opened.

5. The device in accordance with claim 4, wherein the valve seat produces two different angles of aperture.

6. The device in accordance with claim 5, wherein a first angle of aperture is in a range from 10° to 20°, and a second angle of aperture is in a range from 30° to 50°.

7. The device in accordance with claim 4, wherein the stepped valve seat has a contour which is formed by an insertion sleeve positioned within the valve chamber.

8. The device in accordance with claim 2, wherein the exhaust gas valve has a valve stem covered by a cap, which, when the exhaust gas valve is open, lies at least nearly flush with a peripheral wall of the exhaust gas collection chamber.

9. The device in accordance with claim 2, wherein the exhaust gas valve has a valve seat which is stepped such that, when the valve is opened, at least two different angles of aperture are possible, with a smaller angle of aperture being created when the valve is first opened.

10. The device in accordance with claim 3, wherein the exhaust gas valve has a valve seat which is stepped such that, when the valve is opened, at least two different angles of aperture are possible, with a smaller angle of aperture being created when the valve is first opened.

11. The device in accordance with claim 10, wherein the valve seat produces two different angles of aperture.

12. The device in accordance with claim 11, wherein a first angle of aperture is in a range from 10° to 20°, and a second angle of aperture is in a range from 30° to 50°.

13. The device in accordance with claim 5, wherein the stepped valve seat has a contour which is formed by an insertion sleeve positioned within the valve chamber.

14. The device in accordance with claim 6, wherein the stepped valve seat has a contour which is formed by an insertion sleeve positioned within the valve chamber.

15. The device in accordance with claim 9, wherein the valve seat produces two different angles of aperture.

16. The device in accordance with claim 15, wherein a first angle of aperture is in a range from 10° to 20°, and a second angle of aperture is in a range from 30° to 50°.

17. The device in accordance with claim 16, wherein the stepped valve seat has a contour which is formed by an insertion sleeve positioned within the valve chamber.

* * * * *